United States Patent [19]

Iwata et al.

[11] 4,093,477

[45] June 6, 1978

[54] ANISOTROPIC PERMANENT MAGNET ALLOY AND A PROCESS FOR THE PRODUCTION THEREOF

[75] Inventors: Masao Iwata, Chichibu; Hisao Yoshizawa, Kumagaya, both of Japan

[73] Assignee: Hitachi Metals, Ltd., Japan

[21] Appl. No.: 737,268

[22] Filed: Nov. 1, 1976

[51] Int. Cl.[2] ..... C21D 1/04

[52] U.S. Cl. ..... 148/108; 75/126 H; 148/31.57; 148/121

[58] Field of Search ..... 75/126 H; 148/31.55, 148/31.57, 121, 101, 108

[56] References Cited

U.S. PATENT DOCUMENTS

| | | | |
|---|---|---|---|
| 2,002,689 | 5/1935 | Bozorth et al. | 148/108 |
| 3,806,336 | 4/1974 | Kaneko et al. | 75/126 H |
| 3,982,972 | 9/1976 | Iwata et al. | 75/126 H |

*Primary Examiner*—Walter R. Satterfield
*Attorney, Agent, or Firm*—Craig & Antonelli

[57] ABSTRACT

The thermo-magnetic-treated anisotropic permanent magnet alloy of the present invention consists essentially of, by weight, 17 to 45% chromium, 3 to 14.5% cobalt, 0.2 to 5% silicon and balance substantially iron, preferably 23 to 35% chromium, 7 to 14.5% of cobalt, 0.3 to 3% silicon and balance substantially iron and has a residual magnetic flux density of 7000 Gauss or more and a coersive force of 300 Oersted or more. In order to obtain the alloy, an alloy having the above identified composition is initially aged at a temperature of 570° C to 670° C for a period of 10 minutes to 5 hours in a magnetic field and secondarily aged at a temperature within 200° C below the thermo-magnetic treatment temperature for a period of 30 minutes to 50 hours.

18 Claims, 4 Drawing Figures

ANISOTROPIC PERMANENT MAGNET ALLOY AND A PROCESS FOR THE PRODUCTION THEREOF

BACKGROUND OF THE INVENTION

The present invention relates to a thermo-magnetically-treated anisotropic permanent magnet alloy comprising iron, chromium, cobalt and silicon as main components, which has a good workability and is easy to heat treat, and to a process for the production thereof.

At present, permanent magnets are practically used mainly for motors, various meters and electric devices, but magnetic properties required may vary broadly depending upon the nature of final uses. Therefore, there are too many kinds of permanent magnet alloys having such magnetic properties. Practically, however, typical alloys are chosen depending upon the degree of coercive force required. For example, in order to obtain coersive force required, an appropriate alloy is selected from the group of Fe-Mn-Ti alloys, Fe-Co-V alloys, Fe-Ni-Cu alloys, Alnico alloys and rare earth-cobalt sintered alloys.

Fe-Mn-Ti alloys have good workability but have relatively low coercive force, such as 50 to 160 Oersted. It is well known that Alnico alloy can not only cover broad ranges of magnetic properties when compositions thereof are changes, but also is the most commercially available, but they are too hard and are too brittle to be machined and, therefore, poor in workability.

Fe-Co-V alloys, i.e., so-called "Vicalloy" are famous as magnets having a good workability, but they have only one and great defect of being expensive because of containing more than 50% cobalt and more than 10% vanadium.

Fe-Ni-Cu alloys, i.e., so-called "Cunife" have an excellent workability, and they can readily have a high coersive force, but can have only a relatively lower residual magnetic flux density. Therefore their uses are restricted.

SUMMARY OF THE INVENTION

The object of the present invention is to provide thermo-magnetically treated anisotropic permanent magnet alloys which are free of such defects as mentioned above, namely, being cheap, and having excellent magnetic properties which compare with that of Alnico alloys and further having a good workability. And also it is further object to provide a process for the production thereof. These alloys are the thermo-magnetically treated ones which consist essentially of, by weight, 17% to 45% chromium, 3% to 14.5% cobalt, 0.2% to 5% silicon and balance substantially iron, and particularly the alloys consisting essentially of 23% to 35% chromium, 6% to 14.5% cobalt, 0.3% to 3% silicon and balance substantially iron can have more excellent magnetic properties. In view of these alloying compositions, these alloys exhibit a very excellent workability when, for example, forged, rolled, cut, punched or bent under both hot and cold conditions.

In order to give the best magnetic properties to said alloys, the thermo-magnetic treatment and subsequent heat-aging are necessary. Before the thermo-magnetic treatment the alloy is necessary to be a single phase metallurgically. So, in some time a solution treatment is done for this purpose. The temperature necessary for the solution treatment of the alloys having said compositions may range normally from 650° to 1,300° C, preferably from 850° C to 1,085° C. However, instead of the solution treatment a working under hot conditions may be performed. According to the present invention, the thermo-magnetic treatment is essential to obtain excellent magnetic properties. After the solution treatment or the hot working the alloy is initially aged at a temperature of 570° C to 670° C for a period of 10 minutes to 5 hours in a magnetic field. The temperature of the thermo-magnetic treatment ranges preferably from 590° to 650° C. Two phase separation takes place by this aging.

Further, it is necessary to age secondarily the thermo-magnetically treated alloy to produce the good magnetic properties.

The secondary aging is performed by heating the thermo-magnetically treated alloys at the temperature within 200° C below the thermo-magnetic treatment temperature, and then either cooling said alloys at a controlled cooling rate or maintaining said alloys at the temperature for a given period of time. In either case the secondary aging is performed for a period of 30 minutes to 50 hours. Instead of the heating to the secondary aging temperature, it is possible to cool progressively the alloy from the thermo-magnetic treatment temperature to the secondary aging temperature when the thermo-magnetic treatment has been completed. A preferable aging is a gradual reduction in temperature within 200° C below the thermo-magnetic treatment temperature. A more preferable aging is performed by continuous cooling, by more than 10° C, within 200° C below the thermo-magnetic treatment temperature. The cooling is conducted at a rate ranging from 5 minutes to 50 hours for a 10° C drop. A preferable cooling rate is 15 minutes to 10 hours for a 10° C drop. Further, a more preferable cooling rate is 30 minutes to 5 hours for a 10° C drop. The most typical secondary aging takes 10 to 20 hours to cool from about 600° C to about 500° C.

DESCRIPTION OF PREFERRED EMOBIDMENTS OF THE INVENTION

Figure 1:
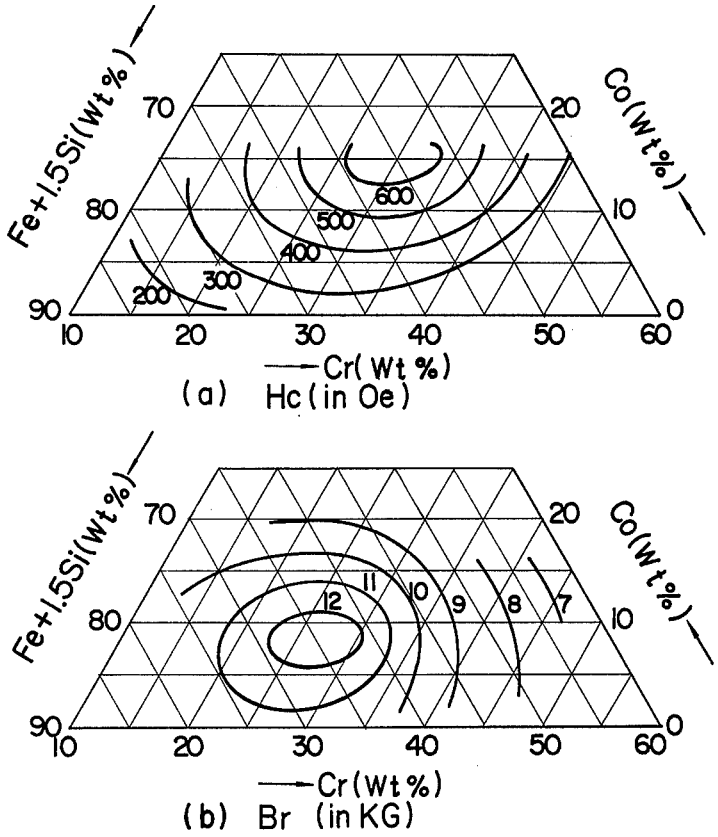
FIG. 1(a) shows the relations between the composition of this invention and coercive force.
FIG. 1(b) shows the relations between the composition of this invention and residual flux density.

The present invention is constituted by two main parts: one is an alloy composition capable of providing anisotropic permanent magnet properties and the other a process for affording said alloy composition excellent in magnetic properties. The present invention will be explained detailedly below:

The alloy of the present invention is fundamentally a Fe-Cr-Co base alloy having silicon incorporated therein. The Fe-Cr-Co base alloy is well known as Spinodal alloy. Recently, it has been found that a Fe-Cr-Co base alloy having molybdenum or tungsten incorporated therein is usable as a permanent magnet. Such alloy is disclosed in U.S. Pat. No. 3,806,336. However, this alloy has excellent magnetic properties while, in view of the aspect of microstructure, the solution treatment must be made at a high temperature since at such high temperature a non-magnetic austenite phase is stable and tends to remain at room temperature. Normally, a solution treating temperature of above 1,300° C is required, but there is industrially considerable difficulty in solution treating conducted in vacuum or a non-oxidizing atmosphere and the fluidity of a melt is poor, because of the high chromium content.

In order to improve the above defects in the alloy Iwata et al proposed a heat-treated alloy that consists essentially of, by weight, 17% to 45% chromium, 3% to 14% cobalt, 0.2% to 5% silicon and balance substantially iron, which was filed in U.S. Pat. application S.N. 560,941 on Mar. 21, 1975 now U.S. Pat. No. 3,982,972. The heat-treated alloy disclosed in the application exhibits comparatively low magnetic properties which are insufficient to use as permanent magnets.

The object of the present invention is to provide an anisotropic permanent magnet alloy exhibiting excellent magnetic properties, particularly, high coersive force. According to the present invention, it has been found that magnetic properties can be improved by selecting the specified composition ranges of the main alloying components and adding an amount of silicon to the alloy.

In the alloy of the present invention chromium is one of the most essential components. If the chromium content is below 17%, the two-phase separation (or Spinodal decomposition), which is necessary to obtain permanent magnet properties, does not take place. If the chromium content is above 45%, the phase which has a conspicuously adverse influence on workability cannot be prevented from occurring. Thus, the alloy containing the chromium content in the range of 17% to 45% is satisfactory to permanent magnet, but in view of the aspect of magnetic properties, the chromium content in the range of 23% to 35% gives the best results.

Cobalt plays an important role in the two-phase separation in association with chromium while, in view of the aspect of microstructure, it has a close relation to the $\gamma$ phase. With respect to the two-phase separation, the lower limit of the cobalt content is 3%. If the cobalt content is below 3%, a coercive force of only 300 Oersted or less is obtained. The coercive force is predominantly increased with the cobalt content increased, but if the cobalt content exceeds 14.5%, the solution treatment becomes very difficult and, as a result, at industrially available solution treating temperatures of below 1,300° C excellent magnetic properties are difficult to obtain. With respect to both the facts that the heat treatment can be easily carried out industrially and excellent magnetic properties can be obtained, the cobalt content in the range of 7% to 14.5% is preferred.

Silicon should be incorporated in an amount of not less than 0.2% into the alloy of the present invention. However, the silicon content exceeding 5% deteriorates the workability under hot and cold conditions. With respect to magnetic properties and workability, the optimum silicon content is in the range of 0.3% to 3%. The range of 0.3% to 3% increase the flowability of the alloy and also prevents precipitation of $\gamma$-phase.

Carbon, magnesium and calcium from a furnace body and raw materials, and manganese from deoxidizing agents are permitted to be incorporated as impurities into the alloy in amounts of up to 0.1% carbon and up to 5% calcium, magnesium and manganese. The incorporation gives adverse influence on both the magnetic properties and workability. And also small amounts of molybdenum and vanadium have no adverse influence. Up to 5% by weight of sum of manganese, molybdenum, calcium and vanadium are permitted.

The solution treatment is important for homogenizing the microstructure of the alloy to obtain uniform magnetic properties. As mentioned above, the addition of silicon serves to remarkably relieve the conditions of the solution treatment. That is, Fe-Cr-Co alloys free of silicon usually require cooling such as water cooling from a temperature of higher than 1300° C, but when a small amount of silicon (not less than 0.2%) is added the high temperature area in which austenite is stable becomes very narrower. It has been experimentally confirmed that Fe-Cr-Co alloys having 0.5 to 1% silicon added thereto are possible to solution treat over an entire high temperature area. This is industrially very significant. Thus, the addition of silicon is greatly advantageous. However, the silicon content exceeding 5% clearly deteriorates the workability and has an adverse influence on magnetic properties, as mentioned above.

In order for the alloy of the present invention to exhibit the optimum magnetic properties, the aging in a magnetic field subsequent to the solution treatment is necessary. And further a secondary aging is necessary. The combination of the specified alloy composition and the heat treating conditions makes it possible to obtain the optimum magnetic properties.

According to the present invention, the aging in a magnetic field is preferably carried out at a maintaining temperature of about 620° C, but it may be carried out at a maintaining temperature of up to about 700° C.

It has been found that the optimum aging conditions for the alloy of the present invention, under which conditions very excellent magnetic properties can be obtained, are in a range between 570° and 670° C for a period of over 10 minutes. The thermo-magnetic treatment is preferably carried out at a temperature of 590° C to 650° C, though, the thermo-magnetic treatment temperature to obtain optimum magnetic properties varies depending on the composition. It is preferable that the period is shorter than 5 hours. A period of longer than 5 hours is uneconomical.

A secondary aging is carried out after the thermo-magnetic treatment. The thermo-magnetic treated alloy is heated at a temperature within 200° C below the thermo-magnetic treatment temperature and then cooled gradually to a temperature of at least 10° C below the beginning temperature. The secondary aging is carried out for a period of 30 minutes to 50 hours.

FIG. 1(a) and 1(b) show the relations between the composition and the magnetic properties particularly the coercive force (Hc) and the residual magnetic flux density (Br), respectively, under constant solution heating and aging conditions. That is, FIG. 1(a) and 1(b) show changes of Hc and Br, respectively, with contour lines for alloys having a silicon content of 1.5% and various chromium and cobalt contents, which were solution treated at 1000° C and then aged at 600° C for 1 hour in a magnetic field of 4,000 Oe and subsequently aged by continuously from 580° to 480° C at a cooling rate of 6.25° C per hour.

The following examples illustrate the present invention.

Example 1

Figure 2:
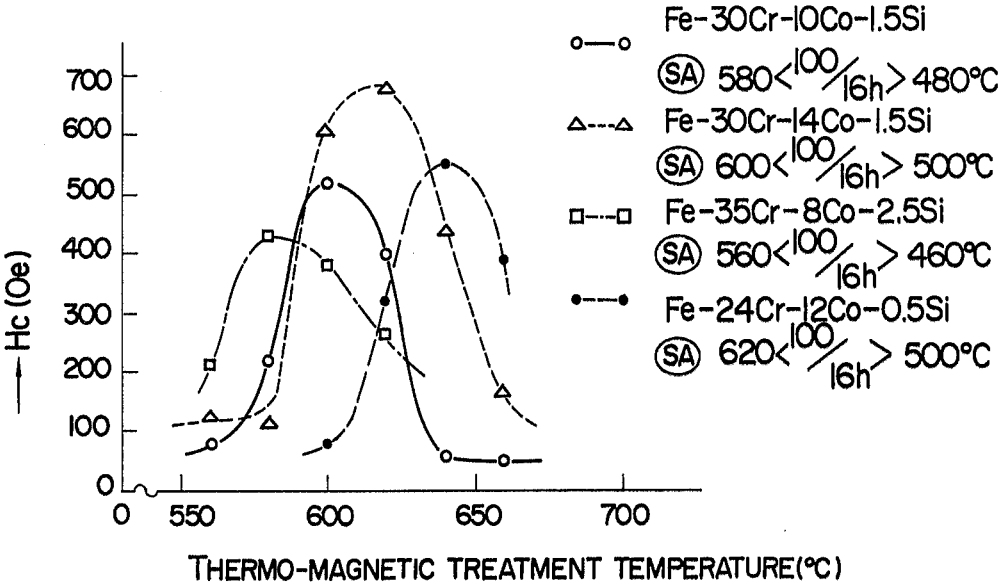
FIG. 2 is a graph illustrating coercive force vs. thermo-magnetic treatment temperature according to this invention.

Some samples were prepared which consisted essentially of 30% chromium, 10% cobalt, 1.5% silicon and balance iron. They were solution treated at 1,000° C for 20 minutes and then aged at various temperatures for 1 hour in a magnetic field of 4,000 Oe. The thermo-magnetically treated samples were further aged by cooling from 580° to 480° C at a rate of 16 hours for 100° C drop. Open circular plots in FIG. 2 shows the relations between the thermo-magnetic treatment temperatures and the coercive force which were exhibited by the above samples.

Another series of samples were prepared which consisted essentially of 30% chromium, 14% cobalt, 1.5% silicon and balance iron. After solution treatment they were aged at various temperatures for 1 hour in a magnetic field of 4,000 Oe. They were secondarily aged by cooling from 600° to 500° C at a rate of 16 hours for a 100° C drop. Their coercive forces are shown by triangular plots in FIG. 2.

The other series of samples were prepared which consisted essentially of 35% chromium, 8% cobalt, 2.5% silicon and balance iron. After solution-treatment they were aged at various temperatures for 1 hour in a magnetic field of 4000 Oe. They were secondarily aged by cooling from 560° to 460° C at a rate of 16 hours for a 100° C drop. Their coercive forces are shown by quadrangular plots in FIG. 2.

The other series of samples were prepared which consisted essentially of 24% chromium, 12% cobalt, 0.5% silicon and balance iron. They were solution treated at 1300° C for 10 minutes, and then aged at various temperatures for 1 hour in a magnetic field of 4000 Oe. They were secondarily aged by cooling from 620° to 500° C at a rate of 16 hours for a 100° C drop. Their coercive forces are shown by closed circular plots in FIG. 2.

According to FIG. 2 it is known that the thermo-magnetic treatment of 570° to 670° C gives excellent coercive force to the above alloys, and the temperature of 590° to 650° C gives more excellent coercive force.

Example 2

Figure 3:
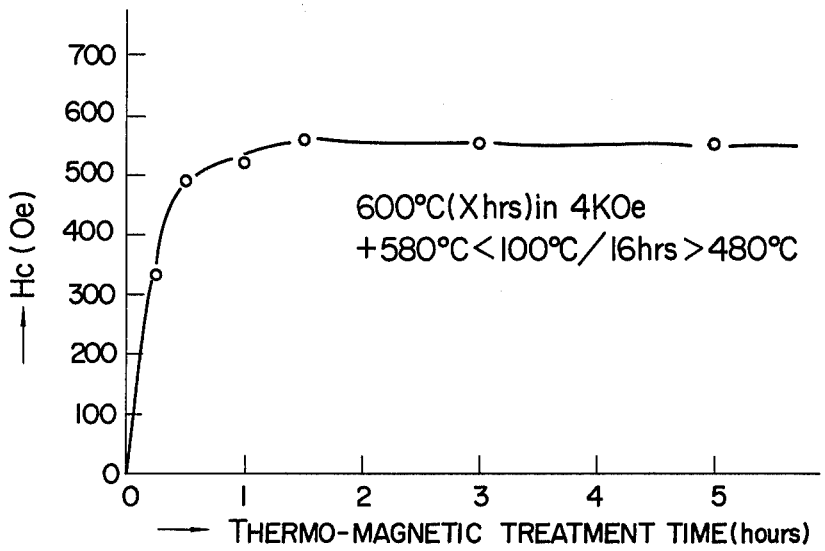
FIG. 3 is a graph illustrating coercive force vs. a period of thermo-magnetic treatment time.

Some samples were prepared which consisted essentially of 30% chromium, 10% cobalt, 1.5% silicon and balance iron. After solution treatment they were aged at 600° C for a period of various times in a magnetic field of 4,000 Oe. They were secondarily aged by cooling from 580° to 480° C at a rate of 16 hours for a 100° C drop. The coercive forces of the heat treated samples are shown in FIG. 3. FIG. 3 shows a thermo-magnetic treatment of longer than 10 minutes gives coercive force of more than 300 Oe and the time of 30 minutes brings the coercive force of the up to the upper limit.

Example 3

Figure 4:
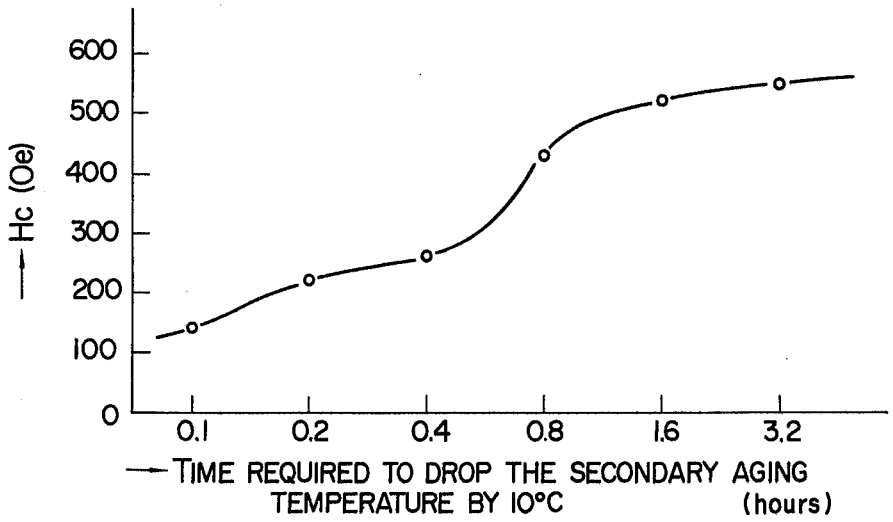
FIG. 4 is a graph illustrating coercive force vs. a cooling rate of secondary aging.

Some samples of 30% chromium, 10% cobalt, 1.5% silicon and balance iron were prepared. They were solution-treated and then thermo-magnetic treated for 1 hour similarly to Example 2. The thermo-magnetic treated samples were aged by cooling from 580° to 480° C at various rates. The coercive forces of the samples are shown in FIG. 4 versus the time required to drop the secondary aging temperature by 10° C. It is known that at least a half hour for a 10° C drop is necessary to obtain coercive forces more than 300 Oe.

Example 4

An alloy consisting essentially of 30% chromium, 10% cobalt, 1.5% silicon and balance iron was solution-treated at 1,000° C for 20 minutes in air and then aged at 600° C for 1 hour in a magnetic field of 4,000 Oe. The thermo-magnetic treated alloy was secondarily aged by cooling from 580° to 480° C at a rate of 16 hours per 100° C. An anisotropic permanent magnetic alloy having a residual magnetic flux destiny (Br) of 11,700 Gauss, a coercive force (Hc) of 520 Oersted and an energy product (BH)max of $4.4 \times 10^6$ gauss Oersted was thus obtained.

Example 5

An alloy consisting essentially of 25% chromium, 8% cobalt, 1.5% silicon and balance iron was solution-treated at 900° C for 30 minutes and then aged at 620° C for 1 hour in a magnetic field of 4,000 Oe and then secondarily aged by cooling from 600° to 500° C at a rate of 16 hours per 100° C. The anisotropic permanent magnet alloy having a residual magnetic flux density (Br) of 12,300 Gauss, a coercive force (Hc) of 410 Oersted and an energy product (BH)max of $3.5 \times 10^6$Gause Oersted was thus obtained.

Example 6

The alloys having composition shown in the following table show the excellent magnetic properties, which were subjected by the heat treatment of the present invention. They were solution-treated at 1,000° C for 20 minutes and aged at 600° C for 1 hour in a magnetic field of 4,000 Oe and then secondarily aged by cooling from 580° to 480° C at a rate of 16 hours per 100° C. The results show small amounts of impurities, such as manganese, molybdenum, calcium and vanadium, have no adverse influence on the magnetic properties.

What is claimed is:

1. A thermo-magnetic-treated anisotropic permanent magnet alloy having a residual magnetic flux density of 7,000 Gauss or more and a coercive force of 300 Oersted or more, said anisotropic permanent magnet alloy being prepared by subjecting an alloy consisting essentially of 17 to 45% by weight of chromium, 3 to 14.5% by weight of cobalt, 0.2 to 5% by weight of silicon and a balance of substantially iron to a solution treatment at 600° to 1300° C., heating the alloy in a magnetic field at a temperature of 570° to 670° C. for a period of 10 minutes to 5 hours, and then aging the thermo-magnetic treated alloy at a temperature within 200° C. below the thermo-magnetic treatment temperature for a period of 30 minutes to 50 hours.

2. The thermo-magnetic-treated anisotropic permanent magnet alloy as set forth in claim 1, wherein the anisotropic magnetic alloy has a residual magnetic flux density of 9,000 Gauss or more and a coercive force of 400 Oersted or more and consists essentially of 23 to 35% by weight of chromium, 7 to 14.5% by weight of cobalt, 0.3 to 3% by weight of silicon and a balance of substantially iron.

3. The thermo-magnetic-treated anisotropic permanent magnet alloy as set forth in claim 1, wherein the anisotropic permanent magnetic alloy further contains up to 5% by weight of sum of manganese, molybdenum, magnesium, calcium and vanadium.

4. The thermo-magnetic-treated anisotropic permanent magnetic alloy as set forth in claim 2, wherein the anisotropic permanent magnet alloy further contains up to 5% by weight of sum of manganese, molybdenum, magnesium, calcium and vanadium.

5. A process for producing an anisotropic permanent magnet alloy having a residual magnetic flux density of 7,000 Gauss or more and a coercive force of 300 Oersted or more which comprises subjecting an alloy consisting essentially of 17 to 45% by weight of chromium, 3 to 14% by weight of cobalt, 0.2 to 5% by weight of silicon, up to 5% by weight of the sum of manganese, molybdenum, magnesium, calcium and vanadium and a balance of substantially iron to a solution treatment at 600° to 1300° C., heating the alloy at 570° to 670° C., in a magnetic field for a period of 10 minutes to 5 hours and then aging the thermo-magnetic treated alloy at a temperature within 200° C below the thermo-magnetic treatment temperature for a period of 30 minutes to 50 hours.

6. The process as set forth in claim 5, wherein said alloy is thermo-magnetic treated at a temperature of 590° C to 650° C for a period of 10 minutes to 5 hours.

7. The process as set forth in claim 5, wherein said alloy is aged by gradual reduction in temperature within 200° C below the thermo-magnetic treatment temperature.

8. The process as set forth in claim 7, wherein said alloy is aged by continuously cooling, by more than 10° C, within 200° C below the thermo-magnetic treatment temperature at a cooling rate of 5 minutes to 50 hours for a 10° C drop.

9. The process as set forth in claim 8, wherein the cooling rate is 15 minutes to 10 hours for a 10° C drop.

10. The process as set forth in claim 9, wherein the cooling rate is 30 minutes to 5 hours for a 10° C drop.

11. The process as set forth in claim 7, wherein said alloy is aged by continuously cooling from about 600° to about 500° C at a cooling rate of 10 hours to 20 hours for a 100° C drop.

12. A process for producing an anisotropic permanent magnet alloy having a residual magnetic flux density of 9,000 Gauss or more and a coercive force of 400 Oersted or more which comprises subjecting an alloy consisting essentially of 23 to 35% by weight of chromium, 7 to 14.5% by weight of cobalt, 0.3 to 3% by weight of silicon, up to 5% by weight of the sum of manganese, molybdenum, magnesium, calcium and vanadium and a balance of substantially iron, to a solution treatment at 600° to 1300° C., heating the alloy in a magnetic field at a temperature of 570° to 670° C for a period of 10 minutes to 5 hours and then aging the thermo-magnetic treated alloy at a temperature within 200° C below the thermo-magnetic treatment temperature for a period of 30 minutes to 50 hours.

13. The process as set forth in claim 12, wherein said alloy is thermo-magnetic treated at a temperature of 590° to 650° C for a period of 10 minutes to 5 hours.

14. The process as set forth in claim 12, wherein said alloy is aged by gradual reduction in temperature within 200° C below the thermo-magnetic treatment temperature.

15. The process as set forth in claim 14, wherein said alloy is aged by continuously cooling, by more than 10° C, within 200° C below the thermo-magnetic treatment temperature at a cooling rate of 5 minutes to 50 hours for a 10° C drop.

16. The process as set forth in claim 15, wherein the cooling rate is 15 minutes to 10 hours for a 10° C drop.

17. The process as set forth in claim 16, wherein the cooling rate is 30 minutes to 5 hours for a 10° C drop.

18. The process a set forth in claim 14, wherein said alloy is aged by continuously cooling from about 600° to 500° C at a cooling rate of 10 hours to 20 hours for a 100° C drop.

* * * * *